US010925409B1

(12) United States Patent
Aramli

(10) Patent No.: US 10,925,409 B1
(45) Date of Patent: Feb. 23, 2021

(54) MATTRESS WHOSE UNDERSIDE HAS A PERIMETER WALL OR A PERIPHERAL FLANGE THAT PARTIALLY BOUNDS A RECESSED CAVITY TO ACCOMMODATE AN ADJUSTABLE POWER BED LAYER OR BED LIFT MECHANISM

(71) Applicant: BEDJET LLC, Newport, RI (US)

(72) Inventor: Mark Darius Aramli, Newport, RI (US)

(73) Assignee: BEDJET LLC, Newport, RI (US)

( * ) Notice: Subject to any disclaimer, the term of this patent is extended or adjusted under 35 U.S.C. 154(b) by 0 days.

(21) Appl. No.: 17/022,036

(22) Filed: Sep. 15, 2020

(51) Int. Cl.

| | |
|---|---|
| ***A47C 21/06*** | (2006.01) |
| ***A47C 27/00*** | (2006.01) |
| ***A47C 23/00*** | (2006.01) |
| ***A47C 20/04*** | (2006.01) |
| *A61G 7/015* | (2006.01) |

(52) U.S. Cl.
CPC ..... *A47C 21/06* (2013.01); *A47C 20/04* (2013.01); *A47C 23/005* (2013.01); *A47C 27/002* (2013.01); *A61G 7/015* (2013.01)

(58) Field of Classification Search
CPC ..... A47C 21/06; A47C 20/04; A47C 20/041; A47C 20/10; A47C 20/12; A47C 23/005; A47C 27/002; A47C 19/12; A47C 19/02; A47C 19/021; A47C 19/122; A61G 7/015
See application file for complete search history.

(56) References Cited

U.S. PATENT DOCUMENTS

| | | | | |
|---|---|---|---|---|
| D593,349 | S | 6/2009 | Pittman | |
| 9,433,546 | B2 * | 9/2016 | Rawls-Meehan | A61G 7/05769 |
| 10,376,074 | B2 * | 8/2019 | Aramli | A47C 20/04 |
| 10,463,153 | B2 | 11/2019 | Aramli | |
| 10,463,163 | B1 * | 11/2019 | Aramli | A47C 19/122 |
| 2005/0011005 | A1 * | 1/2005 | Borda | A47C 20/04 5/412 |
| 2011/0247144 | A1 * | 10/2011 | Oh | A47C 20/041 5/722 |
| 2014/0366267 | A1 * | 12/2014 | Suh | A47C 19/122 5/174 |
| 2015/0208813 | A1 * | 7/2015 | Heeke | A47C 20/04 5/618 |
| 2018/0125250 | A1 * | 5/2018 | Dewert | A47C 27/16 |
| 2019/0298074 | A1 * | 10/2019 | Dan-On | A61G 7/018 |

OTHER PUBLICATIONS

U.S. Appl. No. 17/022,036, filed Sep. 15, 2020, Aramli, Mark, Claims.

* cited by examiner

*Primary Examiner* — Robert G Santos
*Assistant Examiner* — Rahib T Zaman
(74) *Attorney, Agent, or Firm* — Robert J Hess; Hess Patent Law Firm

(57) ABSTRACT

A product upon which a person may lie down that includes a mattress whose underside has a peripheral flange that bounds a recessed cavity into which is placed an adjustable mechanism that can be actuated to raise or lower the head and foot portions of the mattress. The adjustable mechanism in its flattened state is hidden from view from the sides of the mattress by the peripheral flange.

25 Claims, 12 Drawing Sheets

MATTRESS WHOSE UNDERSIDE HAS A PERIMETER WALL OR A PERIPHERAL FLANGE THAT PARTIALLY BOUNDS A RECESSED CAVITY TO ACCOMMODATE AN ADJUSTABLE POWER BED LAYER OR BED LIFT MECHANISM

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO A "SEQUENCE LISTING," A TABLE, OR A COMPUTER PROGRAM LISTING APPENDIX SUBMITTED ON A COMPACT DISC AND AN INCORPORATION-BY-REFERENCE

Not applicable.

BACKGROUND OF THE INVENTION

1. Field of Endeavor to which the Invention Pertains

The invention pertains to a mattress whose underside is equipped with a recess to accommodate an adjustable power bed layer or adjustable bed lift mechanism. Such an adjustable power bed layer or an adjustable bed lift mechanism is a bedframe equipped with a head frame that can raise a head of a mattress and equipped with a foot frame that can raise a foot of the mattress. The adjustable power bed layer and the adjustable bed lift mechanism need not have any legs and may be placed directly on any flat surface, box spring, or stationary non-articulating bed frame (e.g., a platform bed).

2. Description of Information Known to the Inventor, Including References to Specific Documents Related to the Invention, and Specific Problems Involved in the State of Technology that the Invention is Drawn Toward Adjustable bed frames, also called power adjustable bases or power beds, have become a commonplace convenience in bedrooms. The ability to raise and lower the head and legs elevations in beds have many proven benefits and comfort qualities. Typical power adjustable bed frames can lift anywhere from 450 to 800 pounds of evenly distributed weight in a bed.

The construction and design of these adjustable bed frames is nearly universally the same, consisting of a free-standing bed frame structure (typically steel tube) with 4 or 6 legs. The bed frame structure contains articulating head and feet platform sections mounted on pivots to the main frame. These articulating head and foot sections are motion controlled via linear actuators that connect from the main stationary frame and push or pull to create the platform movement. The adjustable bed frames commonly have mattress retainer bars at the foot of the bed, which typically are visible to the consumer when a fitted sheet is placed on the mattress. These retainer bars may make placement of the fitted sheet on the mattress more time consuming and cumbersome.

A broad range of furniture style ornamental bedframes exist that consumers find desirable for their bedrooms. Current adjustable bed frame types are stand-alone mattress frames, with their own legs and mattress support structures. Because of this, many adjustable bed frames are not compatible with existing furniture style bedframes—requiring consumers to forgo a chosen furniture style of bedframe in favor of the limited styles available in current power adjustable bed frames.

Current adjustable bed frames with legs universally have a visible platform on which the mattress rests, and visible retainer bars on that hold the mattress in place. These adjustable bedframes with legs may come upholstered with fabric to improve their cosmetic appearance, but also come non-upholstered, but regardless, the adjustable bed frame is always visible as part of bedroom mattress setup to the consumer. Some consumers may find the visible adjustable bed elements unattractive and undesirable, or non-matching to the decor of their overall bedframe and mattress. Thus, there is a need for some consumers to gain the benefits of adjustable bed technology where the adjustable bed frame itself is completely invisible to the consumer when flat.

A nested bedframe assembly is one in which an articulating portion of the frame is nested within the same plane as the fixed support structure of the frame (i.e., the section with the legs). Many conventional designs don't nest at all—the articulating portion rests on top of the fixed support structure of the frame with the legs. They don't care about dimensional height issues because their designs are complete, free standing, bed platforms with legs. These free standing adjustable bed designs typically will have actuator assemblies or other moving parts projecting below their frames, making it impossible to operate them on flat surfaces without legs.

An example of a nested frame is in United States Patent Application Publication No. 2014/0366267, which discloses a motorized foldable bed frame assembly configured to fold from an open co-planar assembly to a closed parallel assembly. Such may be a dual-actuating adjustable bed frame, which is collapsible and foldable for ease of shipping. It may be configured for use by extending pivoting frame sections and engaging collapsible support legs and may include a head adjustable frame, or a head and foot adjustable frame. It nests the articulating portion within the inner area of the fixed support structure with the legs.

Some adjustable bed frames claim to fit inside furniture style bed frames. However, in most of these cases consumers must modify or remove support structures or cut holes in the pre-existing furniture style bedframe using tools in order to make the adjustable bed frame legs and platform fit. Platform beds with storage drawers underneath the mattress are impossible to modify for use with any adjustable bed frame with legs.

The present inventor devised the adjustable power bed layer product set forth in U.S. Pat. No. 10,463,163 B1, whose contents are incorporated herein by reference. It has a bed frame that folds from a flattened state to a folded state and from a flattened state to an adjusted state. The bed frame has an inner and outer frame that nest with each other in the flattened state. Head side and foot side actuators drive sliding members back and forth along respective tracks to pivot respective articulating frames between the flattened and adjusted states. The articulating frames are part of one of the inner and outer frames and the tracks are connected to the other of the inner and outer frames. In the folded state, the bed frame is positioned to that one of head side and foot side actuators becomes accessible for maintenance and servicing from above depending upon which way the bed frame is folded about its folding pivot. A key element is that no components of the adjustable power bed layer product protrude above the upper plane or lower plane of the adjust power bed layers frame structure, allowing it to be placed on any flat surface without legs.

The present inventor devised the adjustable bed lift mechanism set forth in U.S. Pat. No. 10,376,074 B2, whose contents are incorporated herein by reference. It has linkages and has an actuator connected structure that is movable from a non-actuated position to two or three actuated positions. One set of the linkages lifts the bed frame with the actuator connected structure moved into an associated one of the actuated positions and then push another set of linkages as the actuator connected structure is moved into another of the actuated positions. In the case where there are three actuator positions, further ones of the linkages move down a bed frame slotted bracket to initially lift the bed frame and, as they reach and end of the slotted bracket as the actuator connected structure is moved to a different actuator position, the one set of linkages pull together to lift the bed frame vertically.

U.S. Pat. No. D593349 S1 depicts a mattress whose underside has recessed portions extending inwardly from opposite sides. The recesses are visible, therefore, from the sides as opposed to being hidden from view.

It is desired to provide a mattress with head and foot powered motion adjustability that can hide from view the adjustable power bed layer product or adjustable bed lift mechanism in its flattened condition. It is also desired to provide such a mattress and adjustable power bed layer combination with no visible mattress retainer bars.

SUMMARY OF THE INVENTION

One aspect of the invention relates to a mattress having an underside with a recessed cavity bounded by a peripheral flange and into which is fitted with one of the power bed layer of U.S. Pat. No. 10,463,163 B1 or the adjustable bed lift mechanism of U.S. Pat. No. 10,376,074 B2 in their completed folded condition so that the power bed layer or the adjustable bed lift mechanism is completely hidden when viewed from the side of the mattress.

BRIEF DESCRIPTION OF THE DRAWING

For a better understanding of the present invention, reference is made to the following description and accompanying drawings, while the scope of the invention is set forth in the appended claims.

DETAILED DESCRIPTION OF THE INVENTION

Figure 1:
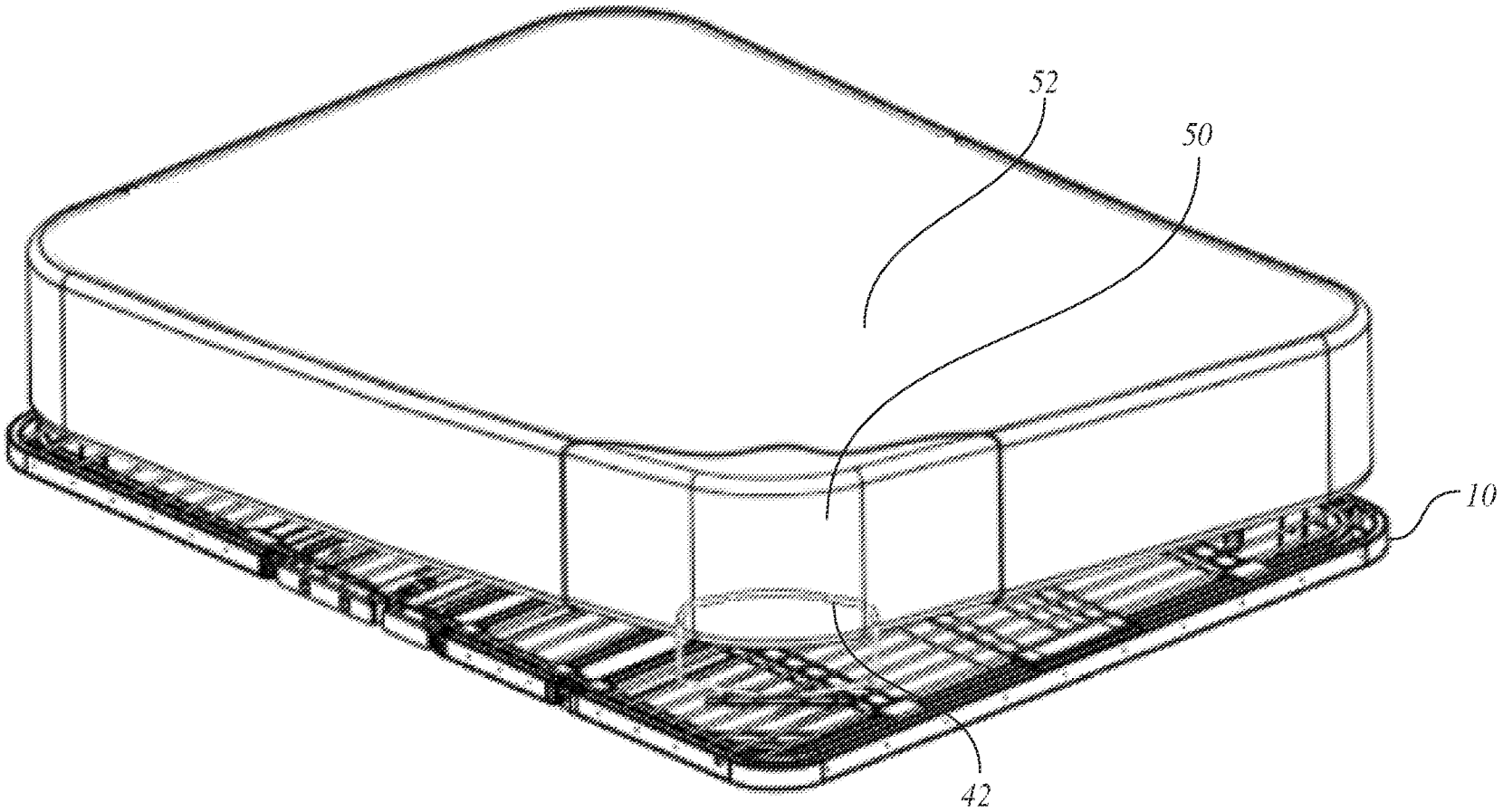
FIG. 1 (PRIOR ART)
FIG. 1 is an isometric view of a conventional mattress being placed upon a conventional adjustable power bed layer as shown in FIG. 27 of U.S. Pat. No. 10,463,163, B1.
Figure 2:
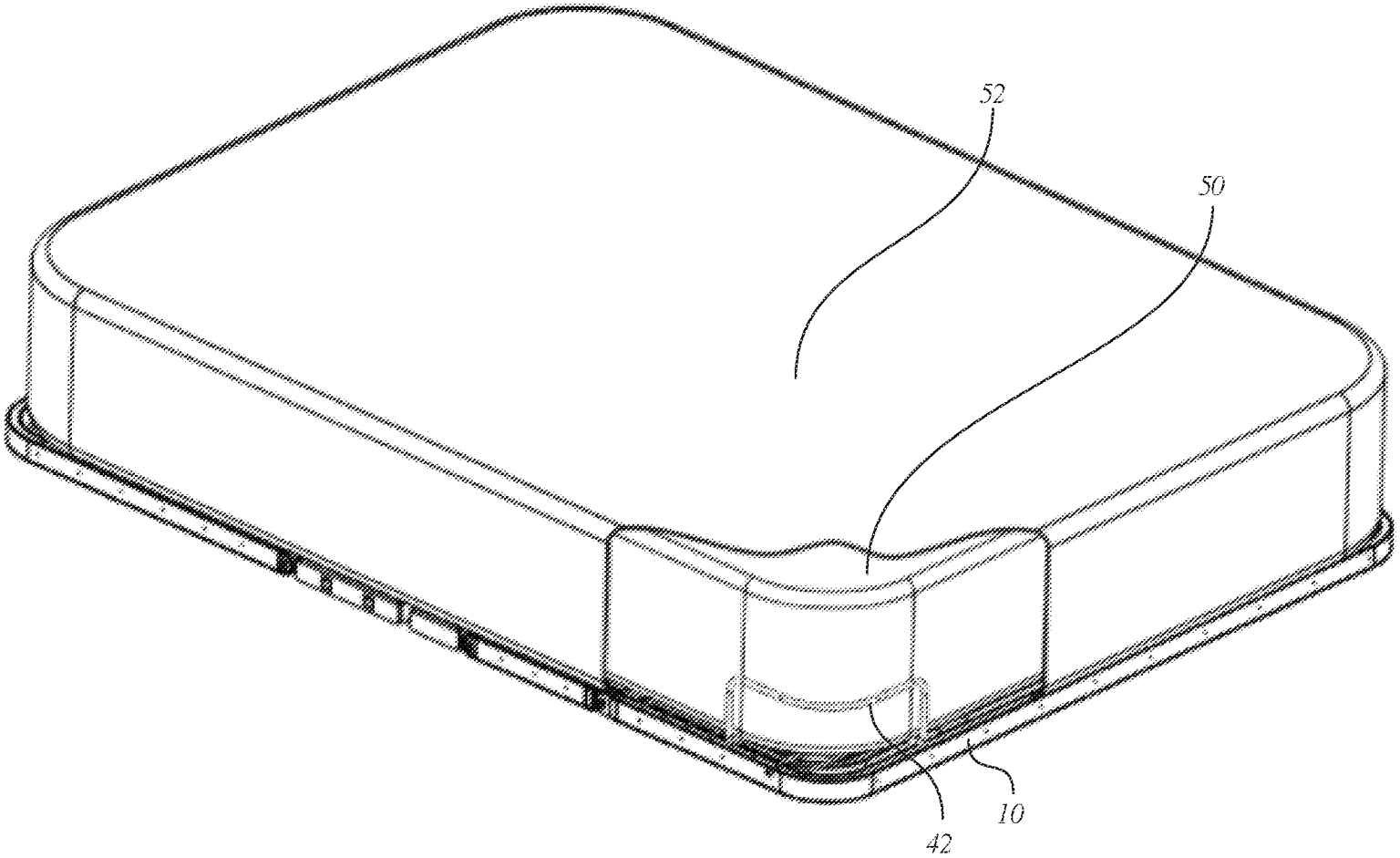
FIG. 2 (PRIOR ART)
FIG. 2 is a schematic representation of a side view of the conventional mattress being placed upon a conventional adjustable power bed layer of FIG. 1. Note the adjustable bed layer would be visible to the consumer.

Turning to the drawings, FIG. 1 and FIG. 2 show an adjustable power bed layer/base 10 underneath a mattress 50 in accord with FIG. 27 and FIG. 28 of U.S. Pat. No. 10,463,163 B1, whose contents are incorporated herein by reference. The adjustable power bed layer/base 10 may be substituted with the adjustable bed lift mechanism of U.S. Pat. No. 10,376,074 B2, whose contents are incorporated herein by reference.

The mattress 50 is covered by fitted sheet 52, but whose corner region is shown removed to reveal the mattress 50 underneath. Retainer bars 42 are positioned against the mattress 50. While FIG. 1 shows the mattress 50 elevated above the adjustable power bed layer/base 10 prior to its placement upon it, FIG. 2 shows the mattress upon the adjustable bed layer/base 10. The side of the adjustable power bed layer/base 10 is visible beneath the mattress 50 in FIG. 2 and is not hidden from view. Adjustable bed bases that have legs would have similar appearance, with the addition of legs supporting the adjustable bed frame The adjustable power bed layer/base 10 of FIGS. 1 and 2 has an adjustable bed frame with two articulating frames each pivotally movable between flattened and adjusted orientations and separated from each other with a central frame interposed between the two articulating frames. There are two actuators that drive two sliding members respectively to undertake respective sliding back and forth motions and has two connected structures pivotally connecting the two sliding members respectively with respective ones of the two articulating frames to move in unison with the sliding back and forth motions of the two sliding members respectively to thereby pivot the two articulating frames to move between the flattened and adjusted orientations as the central frame remains stationary throughout an entirety of the sliding back and forth motions of the two sliding members wherein the sliding members slide away from the center frame to the flattened orientation and slide towards the center frame to the adjusted orientation. There are no legs that are part of or connected to the adjustable power bed layer/base 10. There are no components of the adjustable power bed layer that protrude below the plane of its frame structure when in a flattened state.

If desired, the adjustable power bed layer/base 10 may be substituted for the adjustable power bed lift mechanism. If so, then the mechanism includes a frame having a fixed portion and having an articulating portion pivotally connected to the fixed portion so that as the articulating portion pivots relative to the fixed portion, an angle of inclination changes between the articulating portion and the fixed portion. Also, there are a plurality of lift mechanisms that actuate successively to exert a respective lifting force on the articulating portion to widen the angle of inclination in succession. An actuator connected structure is provided that moves relative to the fixed portion of the bed frame from a non-actuated position to successive actuated positions where the actuator connected structure triggers successive ones of the lift mechanisms to impart the respective lifting force on the articulating portion accordingly.

The lift mechanisms include a first-stage lift mechanism, which has first-stage linkages, and a second-stage lift mechanism, which has second-stage linkages. The actuator connected structure is configured to move from a non-actuated position to a first-stage actuated position and then to a second-stage actuated position in succession. As the actuator connected structure moves from the non-actuated position to the first-stage actuated position, the first-stage linkages pivot about a first-stage lift pivot, which contacts the articulating portion to exert a lifting force on the articulating portion of the bed frame that widens an angle of inclination between the articulating portion and the fixed portion from lifting of the articulating portion as a consequence of the first-stage linkages pivoting. As the actuator connected structure moves from the first-stage actuated position to the second-stage actuated position, the second-stage linkages pivot about a second-stage lift pivot, which contacts the articulating portion to exert a further lifting force on the articulating portion of the bed frame that further widens the angle of inclination between the articulating portion and the fixed portion from further lifting the articulating portion as a consequence of the second-stage linkages pivoting in a manner in which the second-stage lift pivot exerts the further lifting force. The first-stage lift pivot is completely out of contact with the articulating portion as the second-stage lift pivot contacts the articulating portion in a manner that further lifts the articulating portion.

There may also be a third-stage lift mechanism that has at least one third stage linkage. The actuator connected structure is arranged to move also from the second-stage actuated position to a third-stage actuated position. As the actuator connected structure moves from the second-stage actuated position to the third-stage actuated position, the third-stage linkages pivot about a third-stage lift pivot, which exerts an additional lifting force on the articulating portion of the bed frame that additionally widens the angle of inclination between the articulating portion and the fixed portion from additionally lifting the articulated portion as a consequence of the third-stage linkages pivoting in a manner in which the third-stage lift pivot exerts the additional lifting force. The second-stage lift pivot is completely out of contact with the articulating portion as the third-stage lift pivot contacts the articulating portion in a manner that additionally lifts the articulating portion.

Figure 3:
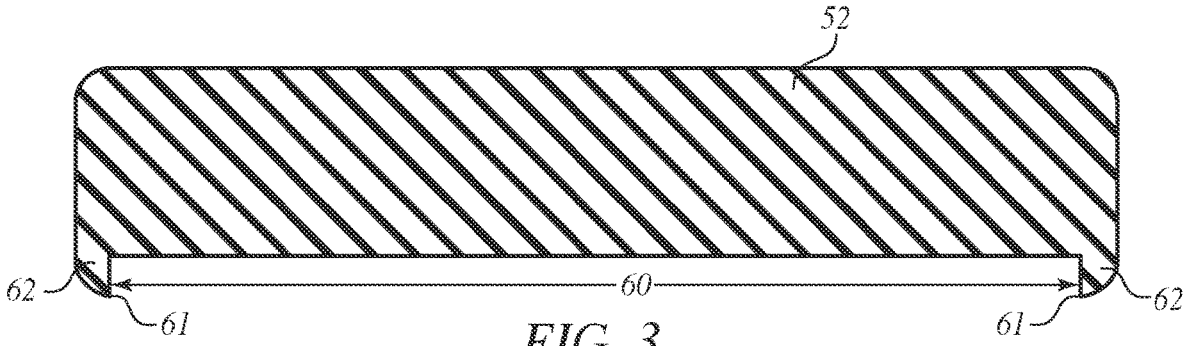
FIG. 3 is a cross-section of a modified mattress in accordance with the invention that has an underside with a peripheral flange that defines a recessed cavity.
Figure 4:
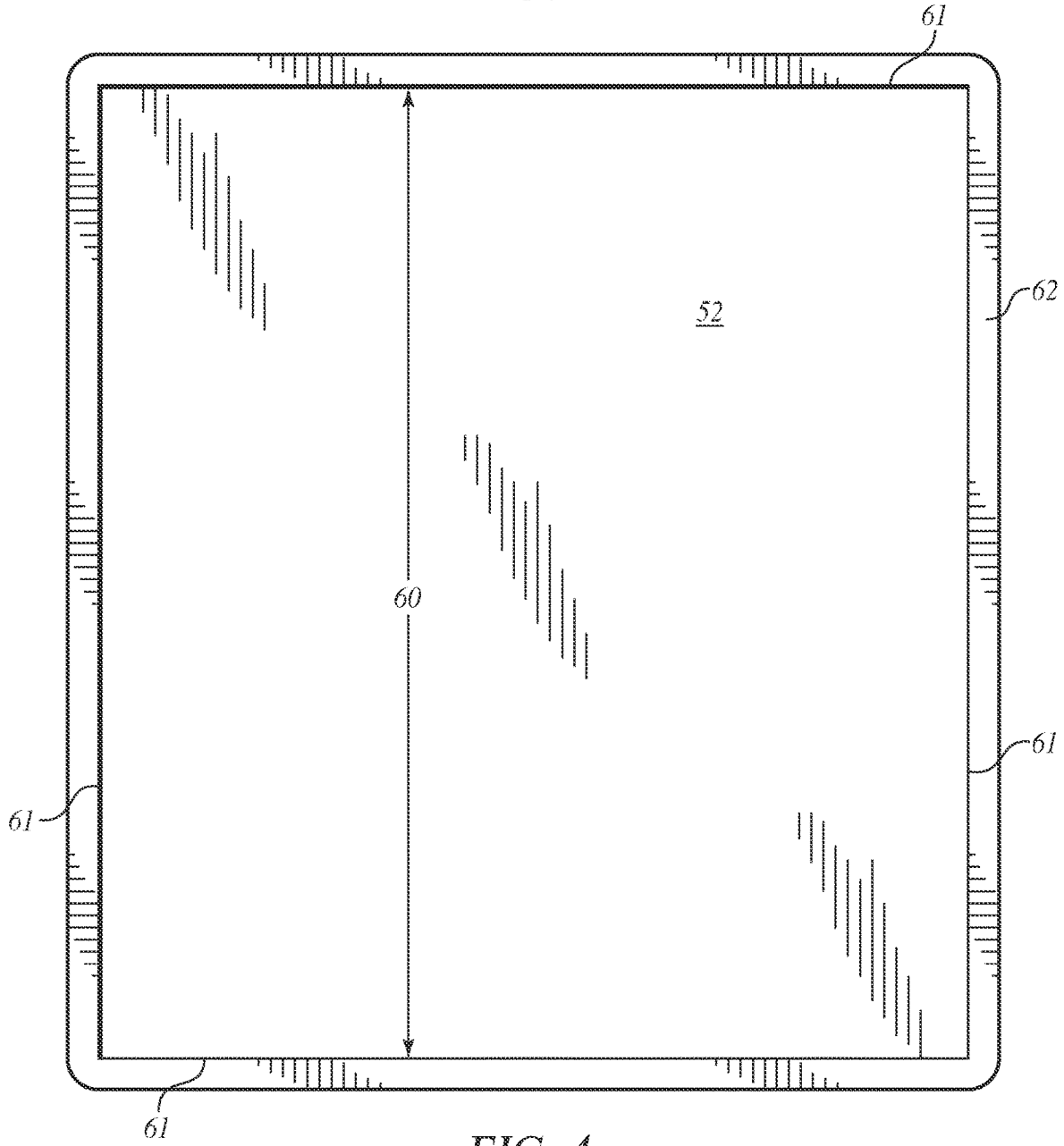
FIG. 4 is a bottom view of the modified mattress of FIG. 3.

FIGS. 3 and 4 show the mattress 50 of FIGS. 1 and 2 (without any of the retainer bars) but modified in accordance with the invention to define a modified mattress 52 whose underside defines a recessed cavity 60 that is bounded at least partially by a perimeter wall or peripheral flange 62. Aside from the perimeter wall or peripheral flange 62 and glue (not shown) to retain the perimeter wall or peripheral flange, the rest of the modified mattress 52 is the same as the mattress 50 of FIGS. 1 and 2, except possibly for the cover that encloses the layers of the mattress 50 of FIGS. 1 and 2. Such a cover could be modified to extend around the perimeter wall or peripheral flange 62 as well. If the cover is not so modified, then the perimeter wall or peripheral flange 62 can have its own matching cover and be glued onto the periphery of the underside of the mattress 50 of FIGS. 1 and 2 to form the modified mattress 52. The recessed cavity 60 is preferably devoid of any material of the mattress 50 or of the mattress 52 as the case may be. The perimeter wall or peripheral flange 62 extends from the underside of the mattress 50 to terminate at an edge that terminates into a lip 61 of the recessed cavity 60.

The invention encompasses two approaches for the mattress:

1) the perimeter wall or peripheral flange 62 is glued or fastened to the bottom of the mattress 52 during factory production, with the mattress cover modified to extend around to the interior of the perimeter wall or peripheral flange 62, in this case the mattress can only be used with the adjustable power bed layer/base 10, and 2) the mattress 52 is produced in an ordinary way with no built-in perimeter wall or peripheral flange 62 and the manufacturer make is available an optional stand-alone perimeter wall or peripheral flange that has the same mattress cover materials on it that can be fastened to the bottom of the mattress via hook and loop, snaps, straps, etc. by the consumer. In this case, the bottom of mattress cover itself would need some simple fastening features on it so that the perimeter wall or peripheral flange could be secured. Such allows the manufacturer to create a normal mattress that can be used without an adjustable power bed layer/base 10, but that includes only a slightly modified bottom cover surface that accepts fastening of the perimeter wall or peripheral flange 62 as an aftermarket add-on.

Figure 5:
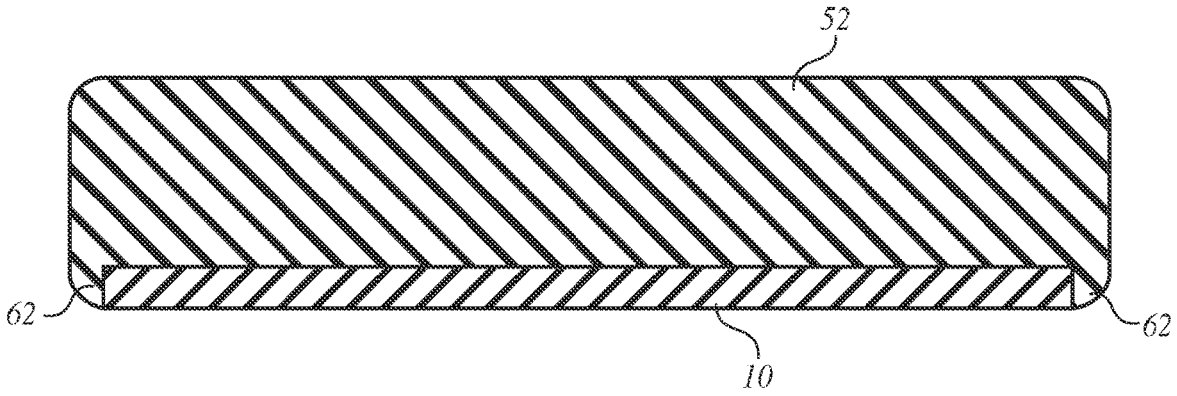
FIG. 5 is a cross-section of the modified mattress of FIG. 3 into whose recessed cavity is fitted an adjustable power bed layer or bed base. This combination of modified mattress and adjustable power bed layer can now be laid on any flat surface including a box spring, platform bedframe or ordinary bedframe.

Turning to FIG. 5, it can be appreciated that the recessed cavity 60 is dimensioned to snugly fit therein the adjustable power bed layer/base 10 in its fully flattened condition. The recessed cavity 60 may have a depth that varies to accommodate adjustable power bed layers or bases of varying height and to accommodate placement therein of the adjustable power bed layer/base 10, which is partially wrapped around by a peripheral flange 62.

Due to its extremely low profile approximate 45 mm height of the adjustable power bed layer/base 10, and its ability to have outer dimensions slightly smaller than the mattress 50 of FIGS. 1 and 2, it also presents the ability for a mattress manufacturer to promote a "mattress with built in adjustability". Essentially the outer dimensions of the mattress 52 in the plane of the adjustable bedframe would be approximately 1" to 2" larger on all sides than the adjustable power bed layer/base 10 itself.

As can be appreciated from FIG. 5, the perimeter wall or peripheral flange 62 at the bottom of the mattress form fits in a snug manner around the adjustable power bed layer/base 10 and thus overlaps the side of the adjustable power layer/base 10. Thus, one can place the adjustable power bed layer/base 10 down on a box spring, and then position the modified mattress 52 on top of the adjustable power layer/base 10. By then accommodating the conventional power bed layer/base 10 within the recessed cavity 60, the conventional power bed layer/base 10 becomes completely hidden inside the recessed cavity 60, giving the appearance of a "built in adjustable bed" to the modified mattress 52 itself, because of the perimeter wall or peripheral flange 62. Yet the conventional power bed layer/base 10 and the modified mattress 52 are put together by simply stacking the latter onto the former in the home.

Figure 6:
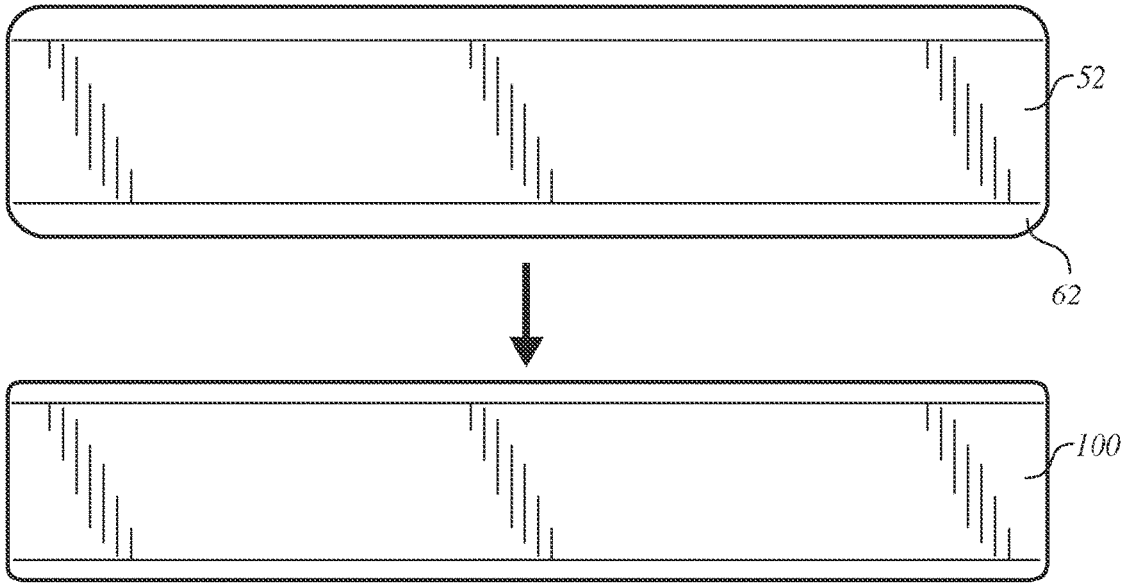
FIG. 6 is a side view of the modified mattress of FIG. 5 with the adjustable power bed layer or bed base hidden from view from the side by the peripheral flange and showing a box spring, upon which the modified mattress is placed.

To assemble, the adjustable power bed layer/base 10 is placed initially on a box spring 100 of FIG. 6 and then the modified mattress 52 is placed on top with its recessed cavity 60 accommodating therein the adjustable power bed layer/base 10. As an alternative to the box spring 100 of FIG. 6, a platform bed base 102 or any other typical bed frame may be used instead. That is, the adjustable power bed layer/base 10 is placed initially on the platform bed base 102 of FIG. 7 and then the modified mattress 52 is placed on top with its recessed cavity 60 accommodating therein the adjustable power bed layer/base 10.

Figure 7:
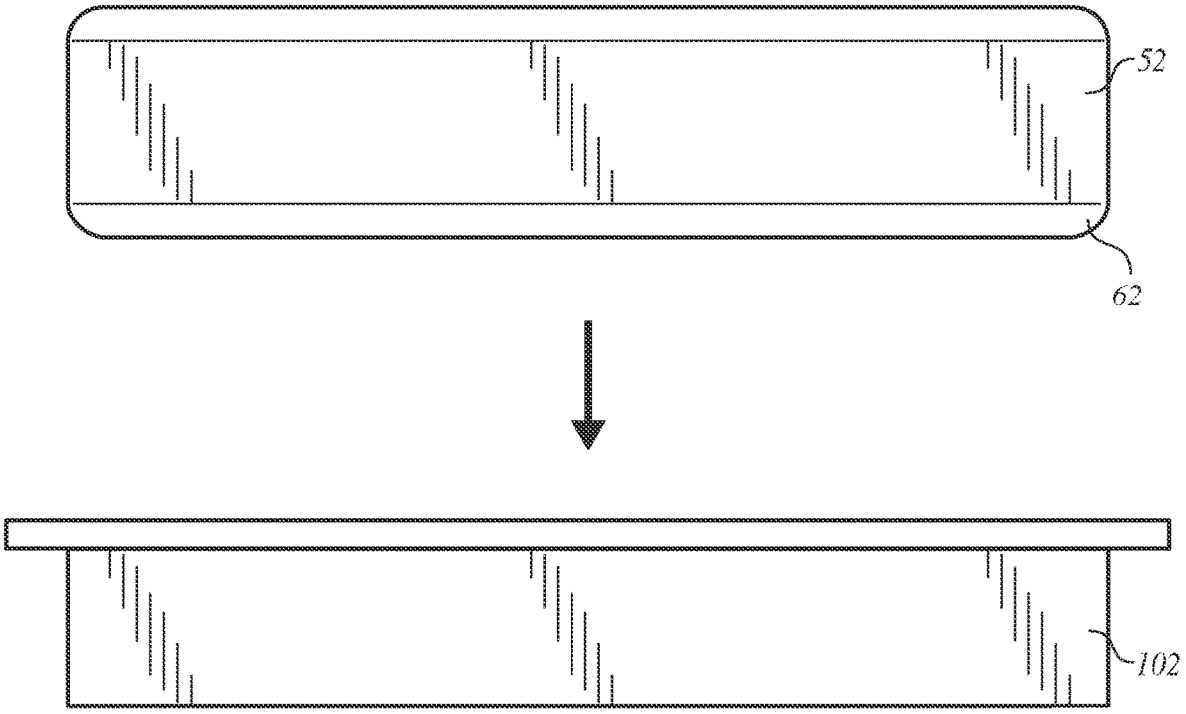
FIG. 7 is a side view of the modified mattress of FIG. 5 with the adjustable power bed layer or bed base hidden from view from the side by the peripheral flange and showing a platform bed base, upon which the modified mattress is placed.

With respect to FIGS. 6 and 7, the modified mattress 52 has a topside and four sides, with its underside placed upon a surface such as the box spring 100 of FIG. 6 or the platform bed base 102 of FIG. 7 and recessed cavity 60 and the adjustable power bed layer 10 in its flattened condition are thus hidden from view when in use, because the peripheral flange 62 blocks one from seeing them.

In accordance with the invention, one may convert any conventional mattress 50 of FIGS. 1 and 2 to the same configuration of FIG. 3 just by securing a raised wall (peripheral flange 62) around the bottom perimeter of an existing mattress to create the recessed pocket for the adjustable power bed layer/base 10 or adjustable lift mechanism by using the same foam the mattress is constructed with and matching mattress cover material. As long as the perimeter wall (or peripheral flange 62) on the bottom of the mattress is fastened in place securely, it will act as if it was part of the mattress allowing one to put a fitted sheet onto the whole thing. The perimeter wall (or peripheral flange 62) is not expected to extend around an entirety of the perimeter of the underside of the mattress. A gap or opening is needed at two locations to enable passage of a DC power cord to pass through for powering the adjustable power bed layer/base 10 or adjustable lift mechanism. The two locations are at the head and foot side of the perimeter wall (or peripheral flange 62) to allow for rotation of the mattress over time due to wear as is common practice for mattresses over the course of years.

Figure 8:
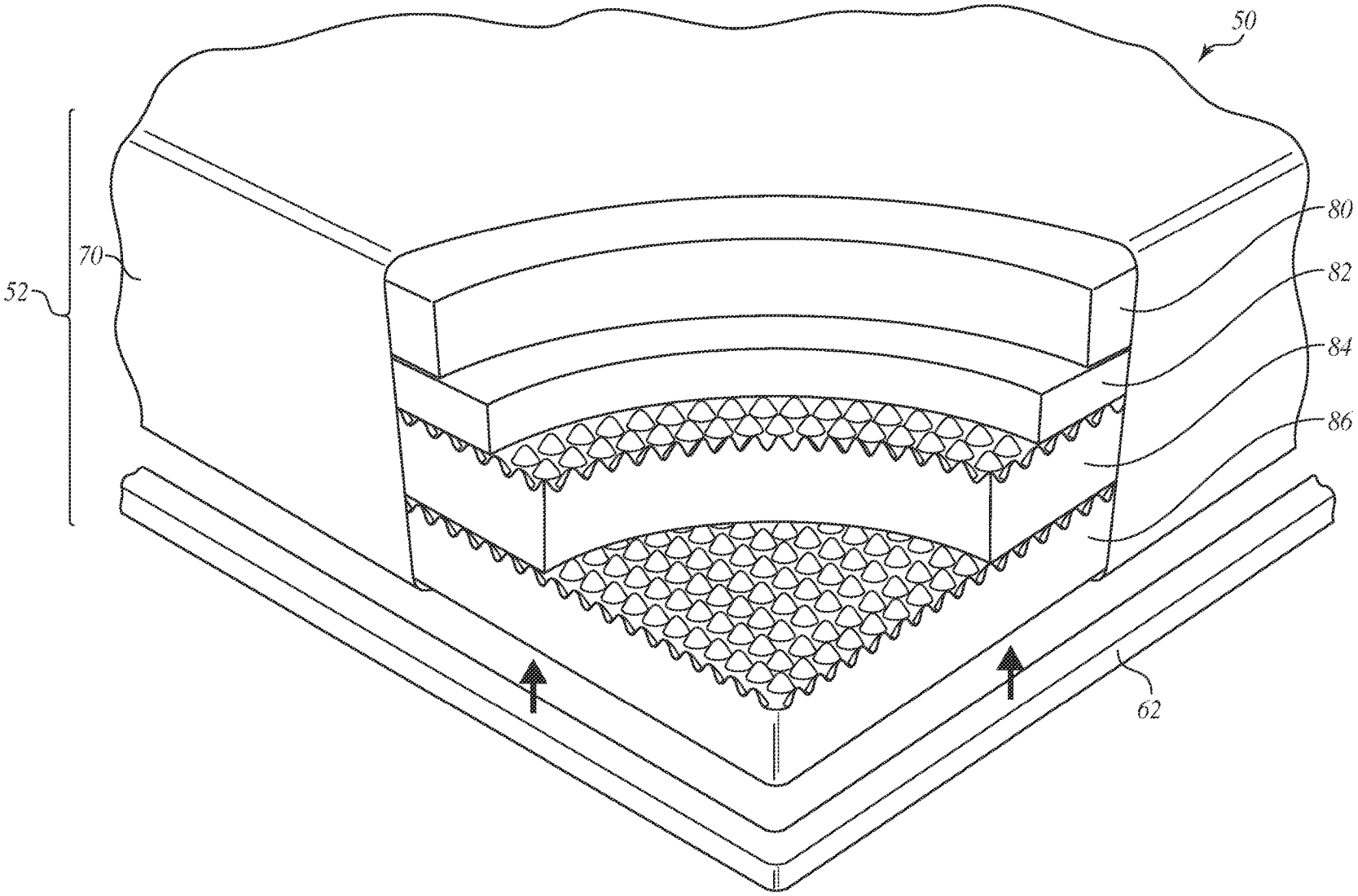
FIG. 8 is an isometric, broken view of a corner region of a conventional mattress to reveal foam layers within a cover.
Figure 9:
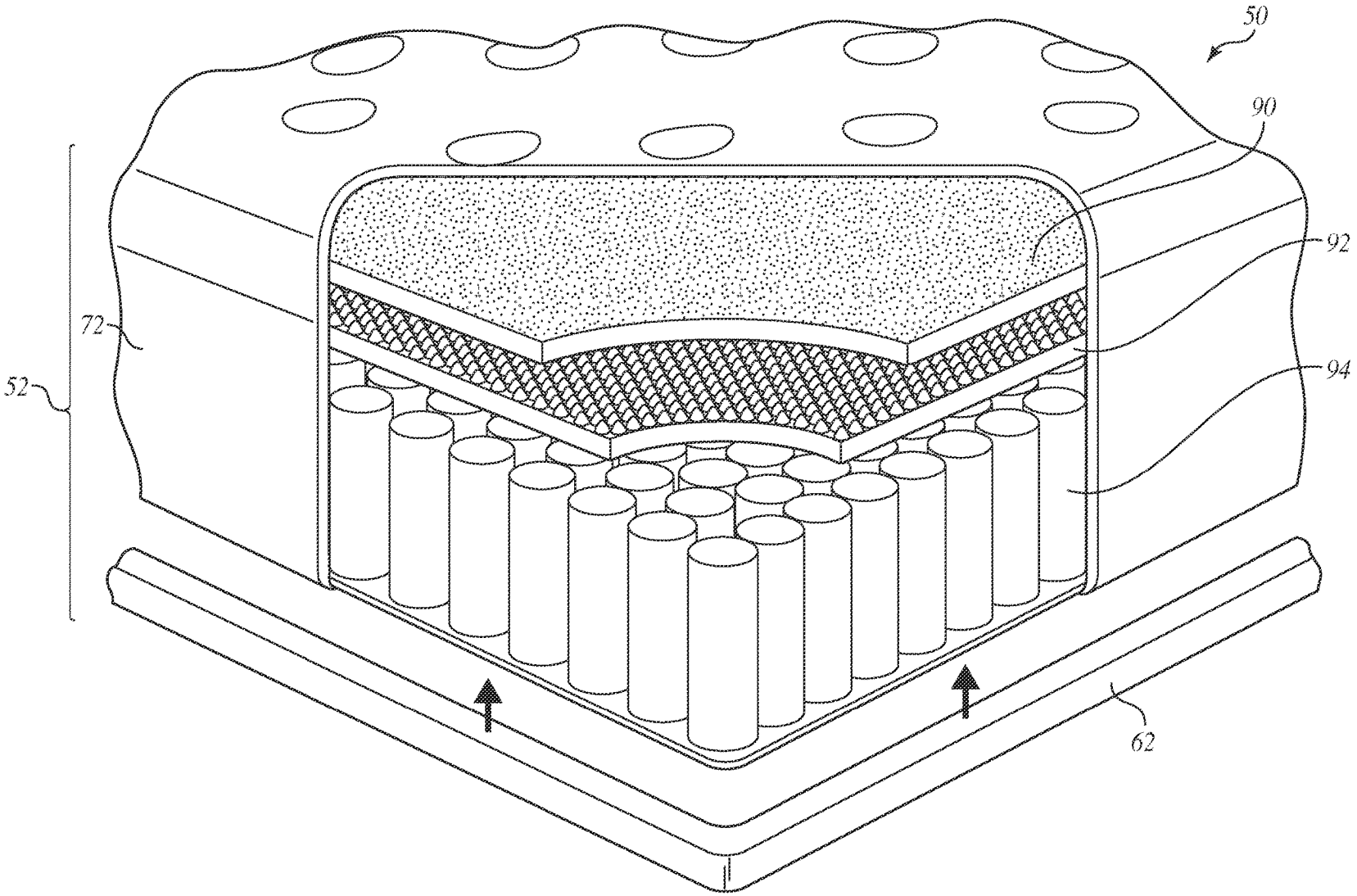
FIG. 9 is an isometric, broken view of a corner region of a further conventional mattress to reveal foam layers, a liner and coils within a cover.

Turning to FIGS. 8 and 9, it can be appreciated that conventional mattresses 50 are typically constructed in layers. The bottom layer will always be a few inches of "base support foam" (which is really stiff) or springs. The layers are typically glued together. In either case, there is always some bottom layer to the mattress before the fabric cover goes on. In the case of the mattress 50 of FIG. 8, the layers from top to bottom within a knitted jacquard cover 70 include memory foam 80, comfort foam 82, high-density foam 84 and high-density base support foam 86. In the case of the mattress 50 of FIG. 9, the layers under a quilted polyester tight-top cover 72 are, from top to bottom, responsive foam 90, edge crate foam 92, felt liner and individually wrapped coils 94. The present invention envisions adhering the perimetrical flange 62 (or perimeter wall) to the underside of any conventional mattress 50.

In the case of FIG. 8, the knitted jacquard cover 70 could be modified to enclose also the peripheral flange 62. In the case of FIG. 9, the quilted polyester tight-top cover 72 could be modified to enclose also the peripheral flange 62. By so extending the cover 70, 72, the modified mattress 52 would appear from the side to be continuous such that one would not notice from the side view that there is the attachment of the peripheral flange 62 to the underside of the mattress layers.

Further, the adjustable power bed layer/base 10 of FIG. 5 (or the adjustable lift mechanism) in its flattened orientation would be hidden from view within confines of the recessed cavity 60 bounded at least partially by the perimeter wall or peripheral flange 62. Indeed, even if the peripheral flange 62 only extended about the periphery of the underside of the mattress along the foot facing side and adjacent two sides of the mattress (but not the head facing side), the adjustable power bed layer/bae 10 (or the adjustable lift mechanism) would still be hidden. This is because the head side of a mattress typically has a headboard that would block one's view of the underside of the mattress. If there is no headboard, then it is typically the head side of the mattress that is adjacent a bedroom wall and thus the wall would block one's view of the underside of the mattress.

In the case of the present invention, preferably, cut foam blocks or strips (stiff as typical mattress base foam) would form the perimeter "wall" or peripheral flange 62 on the mattress base, glued onto the bottom most layer and then upholstered over with the mattress fabric cover.

There may be a risk that the peripheral flange 62 may not be adequate with all mattresses in keeping the mattress from sliding off the end of the bed when the head side is raised (i.e., performing the function of the typical mattress retainer bar at the foo)t. This is probably a larger concern when no weight is on the mattress. Thus, it is preferred that some form of fastening be provided to deter the mattress from sliding off. This form of fastening can be broad sections of hook-loop (VELCRO type) material glued or sewn to the bottom of the recessed surface at the underside of the mattress that defines the recessed cavity and glued or sewn to the top of the adjustable bed power layer, or even providing for mating snaps, or straps, or clamps to effect the fastening of the underside of the mattress to the adjustable bed power layer.

Figure 10:
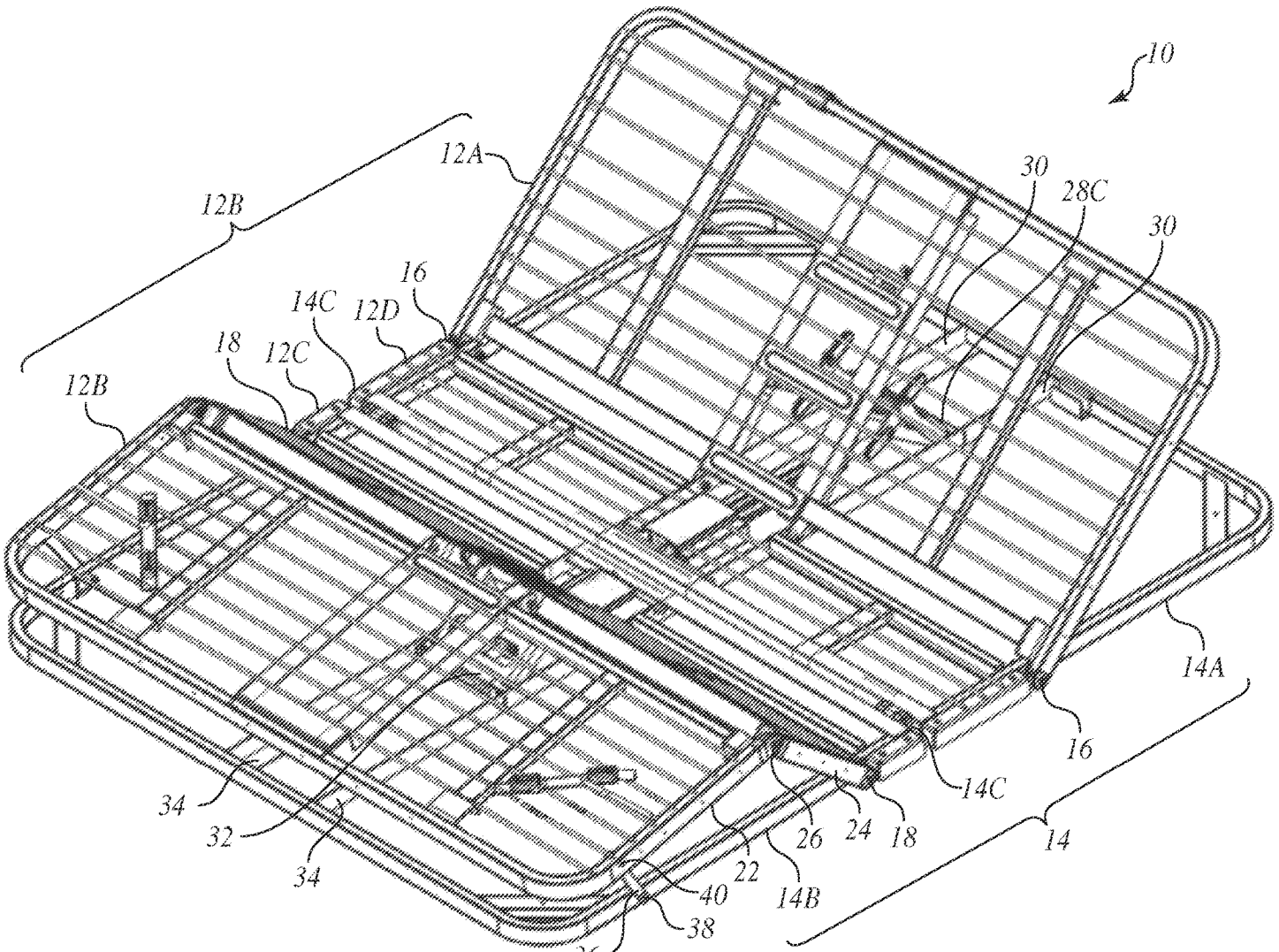
FIG. 10 is an isometric view of the adjustable power bed layer/base in an adjusted state.
Figure 12:
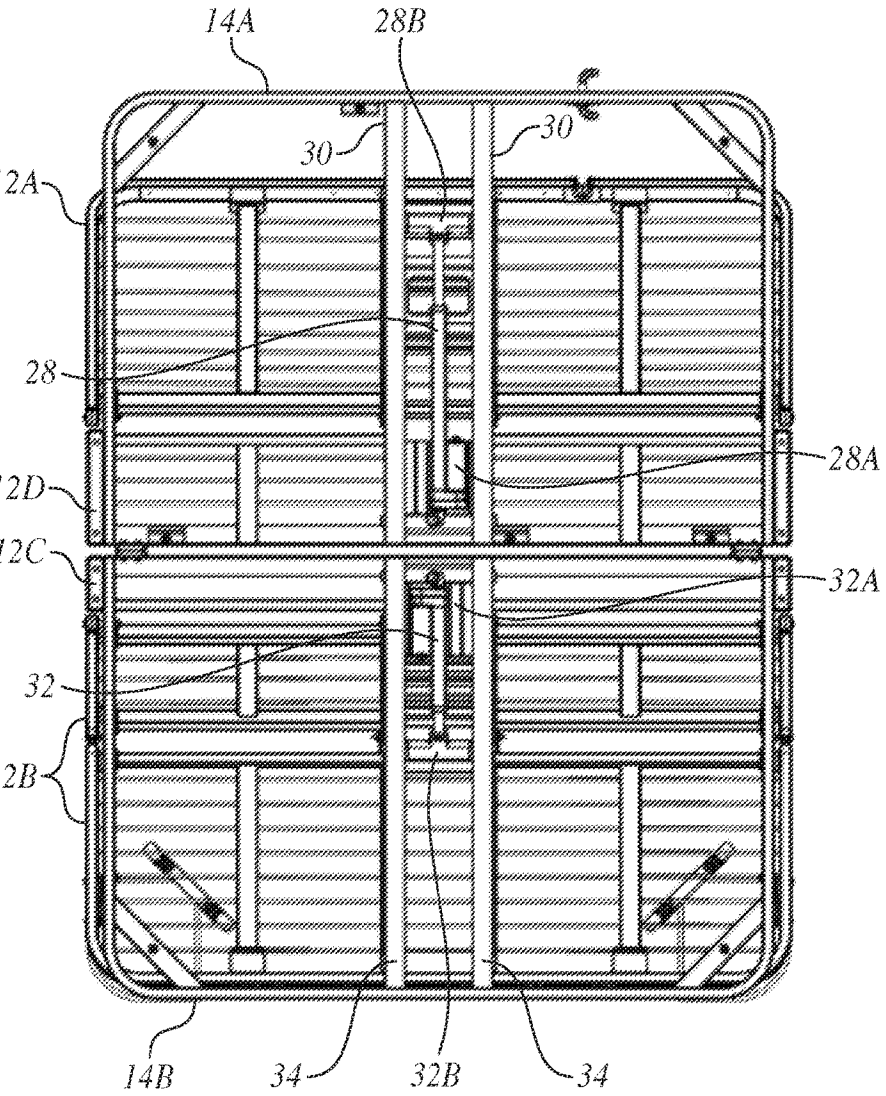
FIG. 12 is a bottom view thereof.
Figure 11:
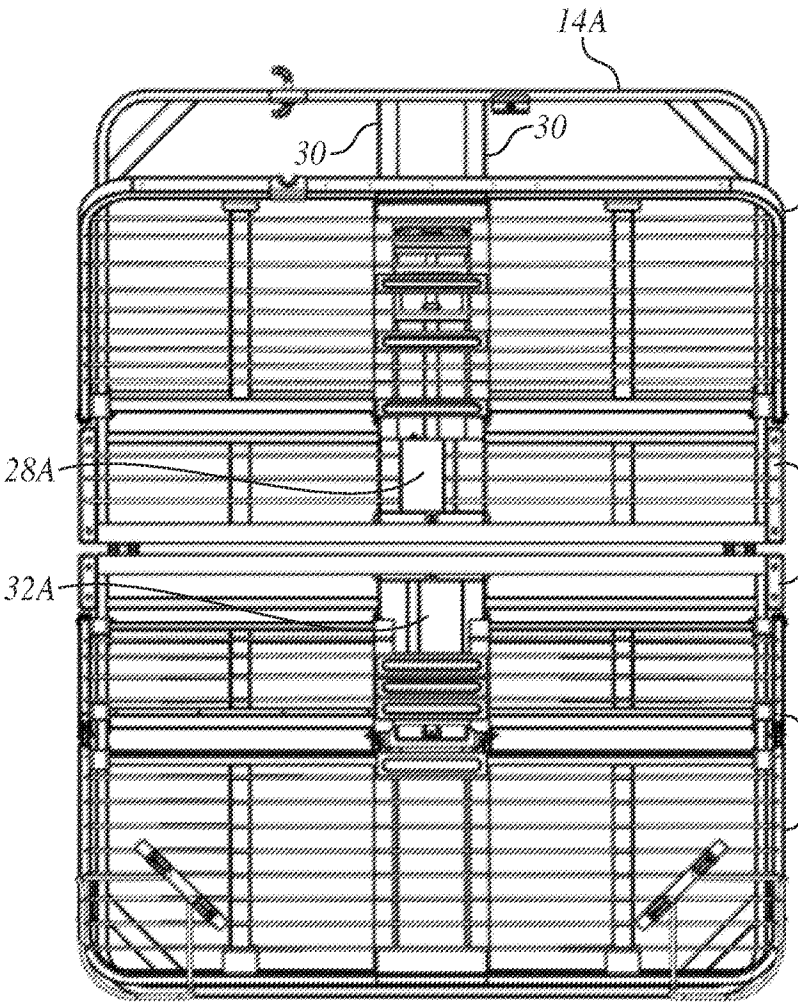
FIG. 11 is a top view thereof.
Figure 13:
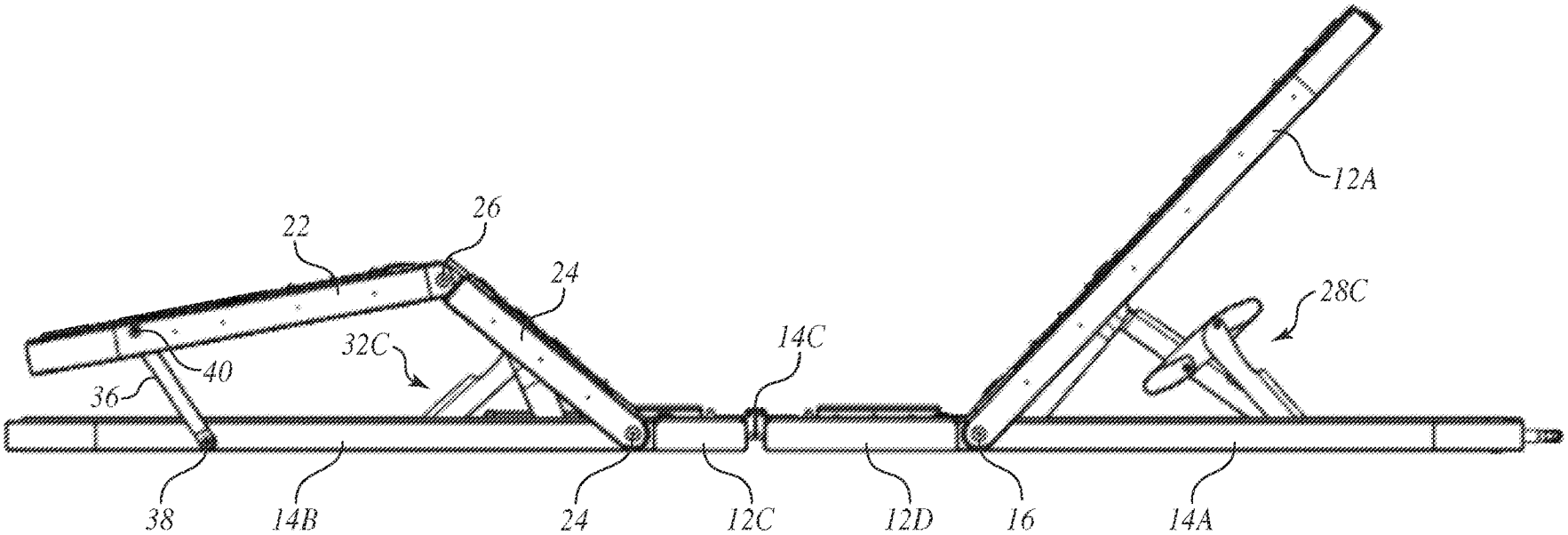
FIG. 13 is a right side view thereof, which is symmetric to the left side view thereof.
Figure 14:
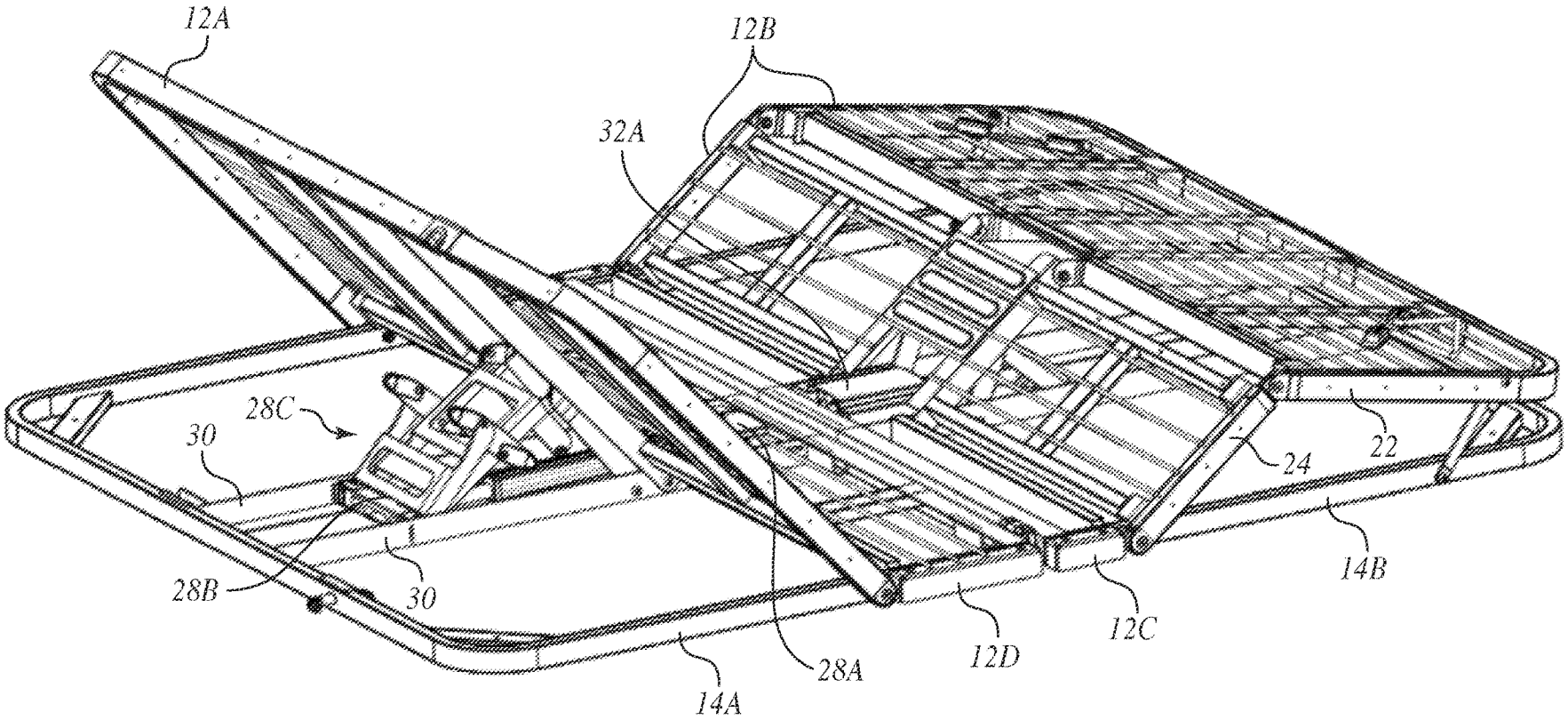
FIG. 14 is a reverse isometric view to that of FIG. 10.

For the sake of brevity, the drawings do not show the adjustable power bed layer/base 10 in its actuated positions shown in FIGS. 13, 16, 20 and 22 of U.S. Pat. No. 10,463,163 B1 although FIGS. 14, 15 and 19 of U.S. Pat. No. 10,463,163 B1 are reproduced as FIGS. 10, 11 and 12 respectively, but any of such actuated positions may arise with the modified mattress 52 on top. By so doing, portions (see head-side stationary frame 14A and foot-side stationary frame 14B (FIGS. 10-13)) of the adjustable power bed layer/base 10 would become visible underneath the modified mattress 52 because of the head and foot of the mattress 52 becoming elevated, but the actuated portions (see head-side articulating frame 12A and foot-side articulating frame 12B (FIGS. 10-13)) remain hidden within the recessed cavity 60. Maintenance of the adjustable power bed layer/base 10 may be carried out in the same manner as set forth in U.S. Pat. No. 10,143,163 B1 by providing access to it upon removal of the modified mattress 52 from the adjustable power bed layer/base 10.

The adjustable power bed layer/base 10 in FIGS. 10-14 may have two support frames, namely, an outer frame and an inner frame. The outer frame includes a head-side articulating frame 12A, a foot-side articulating frame 12B and two center frames 12C, 12D. The inner frame includes a head-side stationary frame 14A and a foot-side stationary frame 14B that are pivotally connected to each other via hinges 14C.

There are folding hinges 16 between one of the two center frames 12D and the head-side articulating frame 12A. There are folding hinges 18 between the foot-side articulating frame 12B and the other of the two center frames 12C. The foot-side articulating frame 12B has two sections 22, 24 between which are folding hinges 26. Folding hinges 16, 18 and 26 each axially connect the outer frame to the inner frame. There are also links 36 pivotally connected via hinges 38 to the foot-side stationary frame 14B and via hinges 40 to the section 22 of the foot-side stationary frame 12B.

There is also a head-side actuator 28 that includes a head-side motor 28A that imparts a force to drive a head-side sliding member 28B (such as a pull bar) to slide back and forth along a track 30. There is a head-side connected structure 28C that operatively connects pivotally the head-side sliding member 28B and the head-side articulating frame 12A. Thus, the head-side connected structure 28C moves in unison with the head-side driven member 28B to pivot the head-side articulating frame 12A about the folding hinges 16 to travel between its flattened and adjusted states.

There is also a foot-side actuator that includes a foot-side motor 32A that imparts a force to a foot-side sliding member (such as a pull bar) to slide back and forth along a track 34. There is a foot-side connected structure 32C that operatively connects pivotally the foot-side sliding member 32B and the foot-side articulating frame 12B. Thus, the foot-side connected structure 32C moves in unison with the foot-side sliding member 32B to pivot the foot-side articulating frame 12B about the folding hinges 18 to travel between its flattened and adjusted states. Such pivoting action about the folding hinges 18 also result in pivoting action about the hinges 26 because the foot-side articulating frame 12B has the two sections 22, 24 pivotally connected to each other at the hinges 26, with section 22 pivotally connected via the hinges 40 to the links 36, which are pivotally connected via the hinges 38 to the foot-side inner frame 14B.

The outer frame nests about the inner frame. The actuators 28 and 32 remain within a height of the inner frame during an entirety of the sliding movements of the respective head-side and foot-side connected structures in the respective tracks 30, 34. That is, the actuators 28 and 32 remain within confines of a volume defined between upper and lower planes of the articulated bed frame and bounded on the sides and ends by the outer and inner frames 12, 14 of adjustable bed frame 10. During an entirety of a lifting movement of the articulating frame, the associated actuator remains above the lower plane of the adjustable bed frame 10.

The inner frame 12 folds in half at the folding hinges 16, without requiring the use of tools to do so. The actuators 28. 32 remain in the same plane as the inner frame 14 in its flattened condition throughout the lifting procedure for the mattress. As an alternative, the actuators 28, 32 each start flat within the same plane as the inner frame 14 and then raise slightly above the plane of the inner frame 14 during the lifting procedure.

Likewise, for the sake of brevity, only some of the drawings of the adjustable bed lift mechanism of U.S. Pat. No. 10,376,074 B2 are reproduced. For the sake of convenience, an adjustable mechanism as set forth herein will collectively refer to the adjustable power bed layer/base of U.S. Pat. No. 10,463,163 B1 as well as to the adjustable bed lift mechanism of U.S. Pat. No. 10,376,074 B2.

Figure 15:
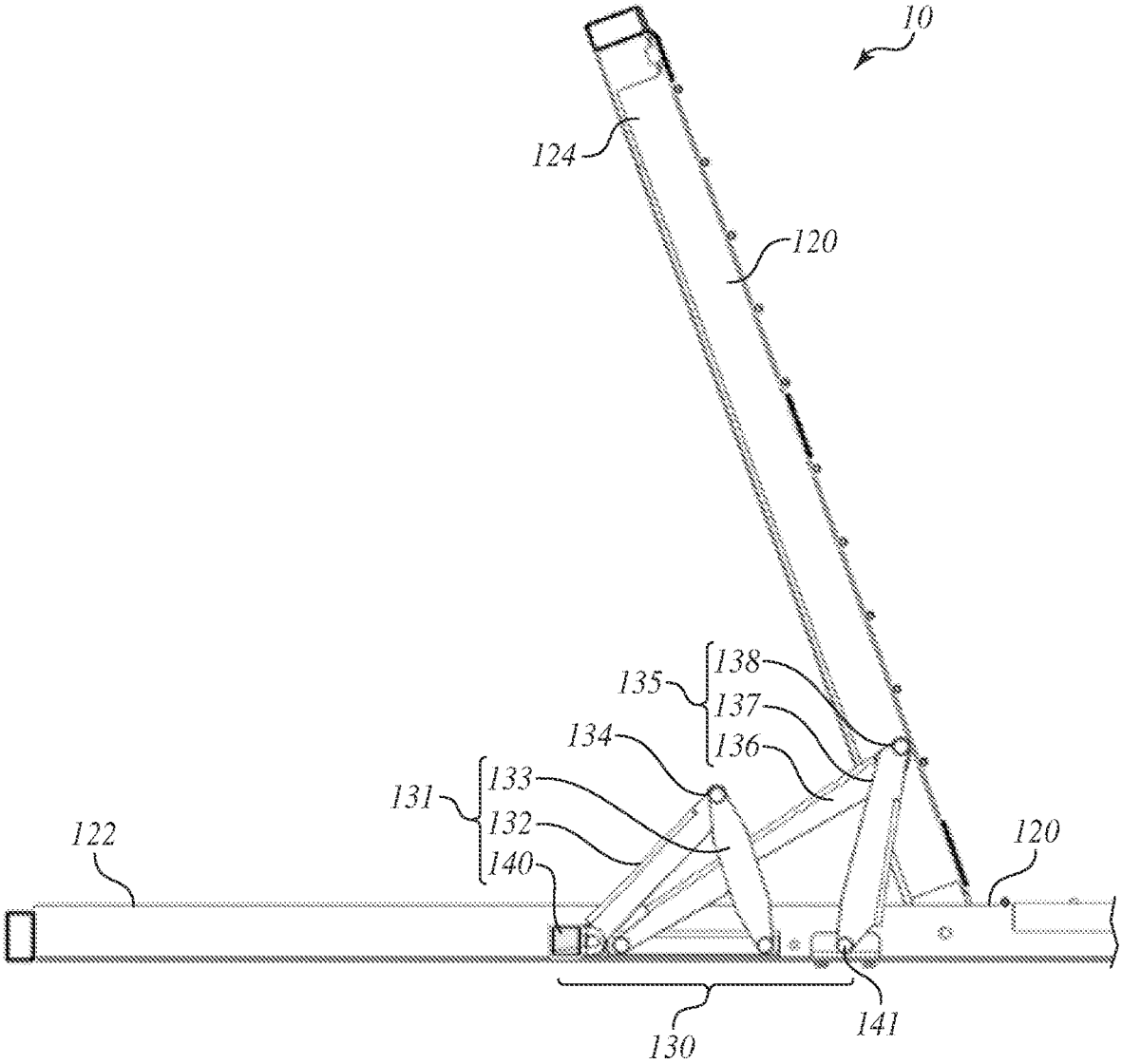
FIG. 15 is a cross section of a bed frame together with an elevation view of a bed lift having an articulated linkage system in the bed frame in accordance with an eight-bar articulated linkage embodiment.
Figure 16:
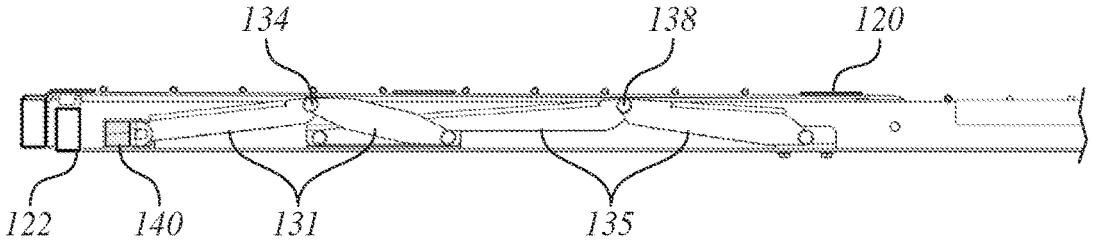
FIG. 16 is an elevation view of a flattened state of the bed lift of FIG. 14 in accordance with the eight-bar articulated linkage embodiment.

The basic principle behind the concept of the power layer of FIGS. 15 and 16 rests on a multi-stage mechanism concept that enables the actuator to be placed in parallel or near parallel with the mattress surface, while still transmitting sufficient force to lift the bed. This allows the power layer to achieve its unprecedented thin profile.

The lifting mechanism of the power layer includes a first stage and second stage mechanism tied to a single actuator. The first stage mechanism is optimized to lift the bed from flat up to a certain distance and angle. As a result, an angle of inclination between the articulating portion 124 of the bed frame 120 and the fixed portion 122 of the bed frame 120 widens as the actuator connected structure moves from its non-actuated position to its first-stage actuated position.

This first stage is designed to most efficiently transmit maximum force from the actuator to the bed while the bed is nearly flat or only partially lifted. However, the limitation of this optimization is that the first stage cannot complete the full travel lifting of the bed, which typically would be 60 to 70 degrees for the head section.

Once that maximum lifting angle is achieved by the first stage, a second stage mechanism that is optimized to lift the bed past maximum first stage angle takes over that lifts the bed the remainder of its intended travel. The second stage mechanism is optimized for lifting once the bed has already been lifted to the angle of the first stage mechanism. As a result, the angle of inclination between the articulating portion 124 of the bed frame 120 and the fixed portion 122 of the bed frame 120 further widens as the actuator connected structure 140 moves from its first-stage actuated position to its second-stage actuated position. The actuator connected structure pulls a "pull-bar 140", which connects to the linkages. The pull-bar 140 travels along a channel in the fixed portion of the bed frame and has a smooth and continuous movement, allowing infinite number of bed articulated positions.

There is an eight-bar articulated linkage 130 in the bed frame 120. The bed frame 120 includes a fixed (inner) portion 122 and an articulating (outer) portion 124 that are pivotally attached to each other. There are first- and second-stage lift mechanisms 131, 135 that are actuated respectively by moving the pull bar 140 to the actuator connected structure accordingly from a non-actuated position to a first-stage actuated position that actuates the first-stage lift mechanism 131 and then to a second-stage actuated position that actuates the second-stage lift mechanism 135. The pull bar 140 to actuator connected structure may pulled to move its actuator or alternatively pushed.

The first-stage lift mechanism 131 includes articulated linkages 132, 133, which pivot about a first-stage lift pivot 134 and are pivotally connected to the fixed (inner) portion 122 of the bed frame 120. The second-stage lift mechanism 135 includes the articulated linkages 36, 137, which pivot about a second-stage lift pivot 138 and are pivotally connected to the fixed (inner) portion 122 of the bed frame 120. For instance, the linkage 137 is pivotally connected at one end to the bed frame 120 at pivot 141.

If desired, the adjustable mechanism may be equipped with legs, preferably legs that pivot to fold between an operative position, at which the legs extend down substantially perpendicular to the plane of the adjustable mechanism in its flattened condition, and a stowed position, at which the legs extend substantially parallel to the adjustable mechanism in its flattened condition and fit within confines of the recessed cavity 60 at the underside of the mattress 52.

While the foregoing description and drawings represent the preferred embodiments of the present invention, it will be understood that various changes and modifications may be made without departing from the scope of the present invention.

What is claimed is:

1. A product upon which a person may lie down, comprising:

an adjustable mechanism;

a mattress having an underside that is bounded by an outer periphery;

a perimeter wall that projects outward from the outer periphery of the underside of the mattress to define a lip, the perimeter wall and the underside of the mattress at least in part bounding a recessed cavity; and an adjustable mechanism fitted within the recessed cavity and that is bounded at least in part by the perimeter wall and by the underside of the mattress, the adjustable mechanism being movable between a flattened condition and an actuated condition, the perimeter wall overlapping a side of the adjustable mechanism within the recessed cavity, the adjustable mechanism in the actuated condition lifting up at least one of a head portion and a foot portion of the mattress relative to that of a central portion of the mattress that is between the head and foot portions.

2. The product of claim 1, wherein the mattress has at least one layer of material within confines of a cover, the perimeter wall being within the confines of the cover.

3. The product of claim 1, wherein the mattress has at least one layer of material within confines of a cover, the perimeter wall being outside confines of the cover.

4. The product of claim 1, wherein the adjustable mechanism has two articulating frames each pivotally movable between flattened and adjusted orientations and separated from each other by a central, stationary frame interposed between the two articulating frames.

5. The product of claim 4, further comprising:

two actuators that drive two sliding members respectively to undertake respective sliding back and forth motions; and two connected structures pivotally connecting the two sliding members respectively with respective ones of two articulating frames to move in unison with the sliding back and forth motions of the two sliding members respectively to thereby pivot the two articulating frames to move between the flattened and adjusted orientations as the central, stationary frame remains stationary throughout an entirety of the sliding back and forth motions of the two sliding members, wherein the sliding members slide away from the central, stationary frame to the flattened orientation and slide towards the central, stationary frame to the adjusted orientation.

6. The product of claim 1, wherein the adjustable mechanism has two halves pivotally connected to each other, wherein the two halves are pivotally movable between flattened and folded states.

7. The product of claim 6, further comprising:

two actuators that drive two sliding members respectively to undertake respective sliding back and forth motions, wherein the two halves are configured so that in the flattened state and within the recessed cavity, the two halves spread out substantially in a planar manner relative to each other and one of the two actuators is at an underside of at least one of the two halves.

8. The product of claim 4, wherein the adjustable mechanism has two actuators that drive two sliding members respectively to undertake respective sliding back and forth motions, the two articulating frames being configured to pivot relative to the central, stationary frame between the flattened and adjusted orientations so that in the flattened orientation, the two actuators remain respectively within confines of a volume bounded between upper and lower planes of associated ones of the two articulated frames that are spaced apart from each other by dimensions of the central frame, the two actuators remaining above the lower plane during an entirety of movement of the two articulating frames.

9. The product of claim 1, wherein the adjustable mechanism includes a frame having a fixed portion and having an articulating portion pivotally connected to the fixed portion so that as the articulating portion pivots relative to the fixed portion, an angle of inclination changes between the articulating portion and the fixed portion.

10. The product of claim 9, wherein the adjustable mechanism includes a plurality of lift mechanisms that actuate successively to exert a respective lifting force on the articulating portion to widen the angle of inclination in succession.

11. The product of claim 10, further comprising:

an actuator connected structure that moves relative to the fixed portion of the frame from a non-actuated position to successive actuated positions where the actuator connected structure triggers successive ones of the lift mechanisms to impart the respective lifting force on the articulating portion accordingly.

12. The product of claim 1, further comprising:

a surface upon which the adjustable mechanism is placed upon and in contact with, the surface being part of a base selected from the group consisting of a box spring and a stationary, nonarticulating bed frame, the surface being outside confines of the mattress.

13. A method of assembling a product upon which a person may lie down, comprising:

bounding a recessed cavity at least in part by a perimeter wall and by an underside of a mattress, the underside of the mattress being bounded by an outer periphery, the perimeter wall projecting outward from the outer periphery of the underside of the mattress to define a lip;

overlapping a side of an adjustable mechanism by the perimeter wall so as to conceal the overlapped side of the adjustable mechanism; and moving the adjustable mechanism between a flattened condition and an actuated condition, the adjustable mechanism in the actuated condition lifting up at least one of a head portion and a foot portion of the mattress relative to that of a central portion of the mattress that is between the head and foot portions.

14. The method of claim 13, further comprising:

confining at least one layer of material of the mattress within confines of a cover; and arranging the perimeter wall within the confines of the cover.

15. The method of claim 13, further comprising:

confining at least one layer of material of the mattress within confines of a cover; and arranging the perimeter wall outside confines of the cover.

16. The method of claim 13, further comprising:

pivotally moving two articulating frames of the articulating mechanism between flattened and adjusted orientations, the two articulating frames being separated from each other by a central, stationary frame.

17. The method of claim 16, further comprising:

driving two sliding members respectively to undertake respective sliding back and forth motions; and pivotally connecting two connected structures to the two sliding members respectively with respective ones of the two articulating frames to move in unison with the sliding back and forth motions of the two sliding members respectively to thereby pivot the two articulating frames to move between the flattened and adjusted orientations as the central, stationary frame remains stationary throughout an entirety of the sliding back and forth motions of the two sliding members, wherein the sliding members slide away from the central frame to the flattened orientation and slide towards the central frame to the adjusted orientation.

18. The method of claim 13, wherein the adjustable mechanism includes a frame having a fixed portion and having an articulating portion pivotally connected to the fixed portion, the adjustable mechanism also including a plurality of lift mechanisms, further comprising:

pivoting the articulating portion relative to the fixed portion so that an angle of inclination changes between the articulating portion and the fixed portion; and actuating the plurality of lift mechanisms successively to exert a respective lifting force on the articulating portion to widen the angle of inclination in succession.

19. The method of claim 13, further comprising:

positioning the adjustable mechanism upon and in contact with a surface of a base selected from the group consisting of a box spring and a stationary, non-articulating bed frame, the surface being outside confines of the mattress.

20. The method of claim 13, further comprising:

actuating the adjustable mechanism into the actuated condition in a manner in which an actuated portion of the adjustable mechanism is at a higher elevation than that of a stationary portion of the adjustable mechanism with the actuated portion being within the recessed cavity and the stationary portion being outside confines of the mattress and exposed.

21. The method of claim 13, further comprising:

stacking the mattress onto the adjustable mechanism by positioning the mattress with the perimeter wall above the adjustable mechanism and then carrying out the overlapping.

22. The method of claim 19, further comprising:

stacking the mattress onto the adjustable mechanism by positioning the mattress with the perimeter wall above the adjustable mechanism and then carrying out the overlapping, wherein the positioning of the adjustable mechanism upon and in contact with a surface of the base occurs before the stacking is carried out.

23. The method of claim 13, further comprising:

equipping the adjustable mechanism with legs.

24. The product of claim 1, wherein the adjustable mechanism is equipped with legs.

25. The product of claim 1, wherein in the actuated condition of the adjustable mechanism, an actuated portion of the adjustable mechanism is at a higher elevation than that of a stationary portion of the adjustable mechanism and is within the recessed cavity while the stationary portion of the adjustable mechanism is outside confines of the mattress and exposed.

* * * * *